US007861700B2

(12) United States Patent
Scoggins

(10) Patent No.: US 7,861,700 B2
(45) Date of Patent: Jan. 4, 2011

(54) SLINGSHOT POUCH

(76) Inventor: Richard H. Scoggins, 10818 Meadowbrook Rd., Georgetown, TN (US) 37336

( * ) Notice: Subject to any disclaimer, the term of this patent is extended or adjusted under 35 U.S.C. 154(b) by 504 days.

(21) Appl. No.: 11/973,131

(22) Filed: Oct. 5, 2007

(65) Prior Publication Data

US 2008/0087262 A1 Apr. 17, 2008

Related U.S. Application Data

(60) Provisional application No. 60/850,164, filed on Oct. 6, 2006.

(51) Int. Cl.
*F41F 1/00* (2006.01)

(52) U.S. Cl. ..... 124/41.1; 124/20.1; 273/126 R

(58) Field of Classification Search ..... 124/20.1, 124/41.1; 273/126 R
See application file for complete search history.

(56) References Cited

U.S. PATENT DOCUMENTS 1,419,682 A * 6/1922 Miles ..... 124/5
1,776,435 A * 9/1930 Isbell ..... 124/5
2,324,201 A * 7/1943 Donaldson ..... 124/20.1
2,644,441 A * 7/1953 Simko ..... 124/5
2,661,731 A 12/1953 Casey
2,823,483 A * 2/1958 Malott ..... 43/19
2,995,129 A * 8/1961 Malott ..... 124/20.1
2,996,060 A * 8/1961 Appleby ..... 124/41.1
3,101,704 A * 8/1963 Richard ..... 124/20.1
3,306,278 A * 2/1967 Spatari ..... 124/22
3,407,798 A * 10/1968 Rock ..... 124/20.2
3,618,585 A * 11/1971 Allison ..... 124/20.2
3,923,034 A * 12/1975 Wolf ..... 124/20.1
3,974,820 A * 8/1976 Ott ..... 124/20.1
3,983,860 A * 10/1976 Bolton ..... 124/20.1
4,131,102 A * 12/1978 Polly, Jr. ..... 124/5
4,240,396 A * 12/1980 Randoll ..... 124/17
4,274,387 A * 6/1981 McBride ..... 124/20.2
4,911,136 A * 3/1990 Brown ..... 124/20.1
4,922,884 A * 5/1990 Ford ..... 124/20.1
5,072,715 A * 12/1991 Barr ..... 124/20.1
5,224,703 A * 7/1993 Osher ..... 473/513
5,383,657 A * 1/1995 Rathmell ..... 124/17
5,427,084 A * 6/1995 Arnold et al. ..... 124/5
5,531,209 A * 7/1996 Liedtke ..... 124/20.1
5,579,750 A * 12/1996 Lease ..... 124/20.1
5,803,067 A * 9/1998 Ellenburg et al. ..... 124/20.1
5,894,672 A * 4/1999 Ellenburg et al. ..... 33/265
6,564,787 B1 * 5/2003 Barry ..... 124/20.1
6,742,509 B2 * 6/2004 Hunter et al. ..... 124/17
6,884,188 B2 * 4/2005 Cherry ..... 473/451
6,968,835 B2 * 11/2005 Lee ..... 124/20.1

(Continued)

*Primary Examiner*—Gene Kim
*Assistant Examiner*—Alexander R. Niconovich
(74) *Attorney, Agent, or Firm*—Kenneth Buffington

(57) ABSTRACT

An improved slingshot pouch with a holding means in which the pouch walls apply equal pressure across the surface of a pressure sensitive projectile. As a result of the uniform pressure on the projectile, it can be fired with confidence that it will not burst or be crushed during the process. The pouch is generally spherically shaped and is formed from a flexible and pliable material. The pouch comprises a triangular handle, a wall, end arms, ribs, and angle arms. The pouch has a smooth inside lining without flex fingers or other projections. The pouch is provided with a triangular gripping element attached in a pigtail fashion at its rearward side.

17 Claims, 8 Drawing Sheets

U.S. PATENT DOCUMENTS

| | | | | |
|---|---|---|---|---|
| 7,389,774 | B1 * | 6/2008 | Fonda | 124/20.1 |
| 7,464,701 | B1 * | 12/2008 | Mendoza et al. | 124/27 |
| 7,506,642 | B2 * | 3/2009 | Edwards | 124/20.1 |
| 7,509,952 | B2 * | 3/2009 | Aiken et al. | 124/20.1 |
| 2003/0034019 | A1 * | 2/2003 | Lewis | 124/20.1 |
| 2003/0101977 | A1 * | 6/2003 | Barry | 124/20.1 |
| 2005/0172944 | A1 * | 8/2005 | Lee | 124/20.1 |
| 2006/0191521 | A1 * | 8/2006 | Gee | 124/20.1 |
| 2008/0053421 | A1 * | 3/2008 | Chang | 124/45 |
| 2008/0078367 | A1 * | 4/2008 | Edwards | 124/20.1 |
| 2008/0099003 | A1 * | 5/2008 | Aiken et al. | 124/20.1 |
| 2008/0156307 | A1 * | 7/2008 | Myers | 124/20.1 |
| 2008/0156308 | A1 * | 7/2008 | Zadra | 124/20.1 |
| 2009/0173329 | A1 * | 7/2009 | Saunders | 124/20.1 |
| 2009/0301455 | A1 * | 12/2009 | Yamashiro et al. | 124/20.1 |
| 2010/0170490 | A1 * | 7/2010 | Saunders | 124/41.1 |

* cited by examiner

SLINGSHOT POUCH

CROSS-REFERENCE TO RELATED APPLICATIONS

This application claims the benefit of U.S. Provisional Patent Application Ser. No. 60/850,164, filed Oct. 6, 2006 by the present inventor.

FEDERALLY SPONSORED RESEARCH

Not Applicable

SEQUENCE LISTING OR PROGRAM

Not Applicable

BACKGROUND

1. Field of Invention

This invention relates to slingshots, and particularly to a slingshot equipped with a novel pouch which facilitates the holding and ready release of paintballs or other similar pressure sensitive ammunition.

2. Prior Art

It is difficult to hold a paintball or other pressure sensitive projectile in the pouch of a conventional slingshot. This arises because the pouch is typically formed of a flat piece of leather or plastic which is simply folded over double between the thumb and forefinger, which apply a holding pressure to the paintball. Often the holding pressure will crush the paintball. U.S. Pat. No. 5,072,715 to Barr discloses a flexile slingshot pouch with handgrip for holding projectile in place. The pouch is lined with flex fingers to hold the projectile in position without the need of gripping it through the pouch. This pouch is suitable for traditional projectiles, but is not suitable for pressure sensitive projectiles. The gripping force exerted by the flex fingers is applied only on a fraction of the projectile's surface area, and will rupture pressure sensitive projectiles such as a paintball. The present invention overcomes the difficulties described above.

BRIEF SUMMARY OF THE INVENTION

The present invention provides an improved slingshot pouch which encloses a paintball or projectile, applying equal pressure at all points on the paintball surface to prevent the paintball from bursting or crushing due to uneven pressure on the paintball during the firing process created by the force of the stretched elastic members.

DETAILED DESCRIPTION

Preferred Embodiment

Figure 1:
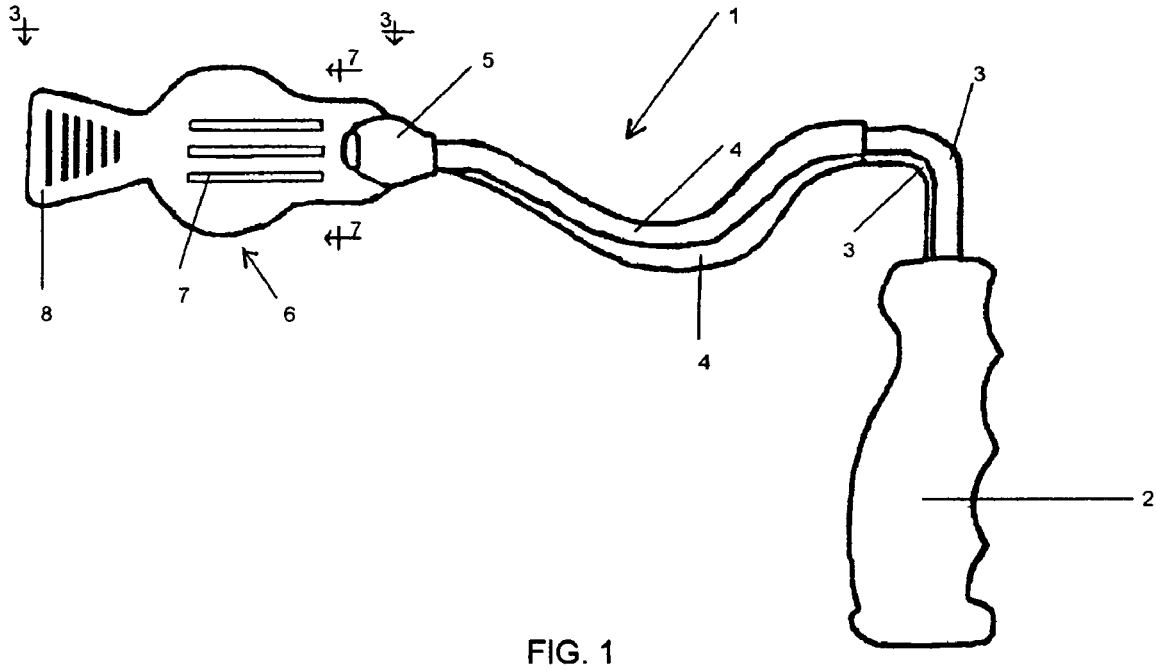
FIG. 1 is a side view of the entire slingshot assembly illustrating the paintball pouch and elastic members in the relaxed condition.

Referring now to the invention in more detail, in FIG. 1 to FIG. 8 there is shown a slingshot 1 having a handle 2 with forks 3 embedded in the handle 2 and extending outward from the handle 2. A pair of elastic members 4 connect between forks 3 and pouch 6. Pouch 6 holds the paintball 13 or projectile in place. Pouch 6 is secured to elastic members 4 by lacing connectors 5 which attach to pouch 6 through openings 14. The openings 14 in the end arms 12 allow the elastic members to attach securely to the pouch 6 at both ends. Pouch 6 is generally spherically shaped and is formed from a flexible and pliable material. The pouch 6 comprises a triangular handle 8, a wall 10, end arms 12, ribs 7, and angle arms 11. The pouch 6 has a smooth inside lining without flex fingers or other projections. Pouch 6 has a triangular 8 gripping element attached in a pigtail fashion at its rearward side.

In further detail still referring to the drawings, the pouch 6 is provided with a triangular handle or release 8 which is used to pull back and hold the pouch 1 in the ready position. The pouch 6 has walls or lining 10 to encompass the paintball 13. A split 9 in the pouch 6 is provided in the walls 10 to allow the pouch 6 to readily open and close. The elastic members 4 are attached to the ends arms 12. Ribs 7 extend down the end arms 12 for support and added force to close the pouch 6. The angle arms 11 utilize the elastic members 4 at end arms 12 to close the pouch 6. The unique triangular shape of the handle or release 8 on the rear of the pouch 6 allows the pouch to be pulled back and released without any squeezing of the paintball 13 with thumb and forefinger which results in the paintball being burst or crushed during the process.

The pouch 6 holds and propels a paintball 13 from a slingshot 1. The pouch 6 forms a pocket about the same size as a given paintball 13. The pouch 6 grips the paintball 13 by the force of the elastic members 4 as the end arms 12 are pulled back, forcing the angle arms 11 and the walls 10 to close around the paintball 13. The triangular release is a gripping device for grasping by the other hand of a user for pulling and stretching the elastic members 4 to place the pouch 6 in the ready position. A secured paintball pouch 6 allows the user to keep the slingshot 1 loaded and in the ready position without the worry of the paintball 13 or projectile falling out of the pouch 6. The paintball 13 or projectile will not simply fall out of the pouch 6 as if it were placed in a conventional leather pouch with no pocket. The pouch angle arms 11 and the pouch walls 10 are designed to cover approximately 75% to 80% of the paintball 13 or projectile surface area, securing the paintball 13 in place without it falling out of the pouch 6.

The manner of using the invention involves placing a paintball 13 in the pouch 6, pulling back the triangular handle 8 to the ready position, aiming at the target and releasing the triangular handle 8 to propel the paintball 13. As the elastic members at end arms 12 are being pulled back, the pouch angle arms 11 and the pocket lining walls 10 are forced to close around the paintball 13. The ribs 7 extending down the end arms 12 provide support and added force to close the pouch 6. The force of the elastic members 4 do not result in crushing or bursting the paintball 13 since the pressure is evenly distributed around the paintball 13. The user can hold and aim the slingshot 1 in the ready position until a decision is made to fire at the target. A simple quick release of the triangular handle 8 propels the paintball 13 towards the target.

By the unique configuration of the spherical pouch 6, a simple but effective pocket is formed which securely holds the paintball 13 or projectile deposited in it, but when released, the pouch 6 readily opens, whereby the paintball 13 or projectile is propelled between the forks 3. The pouch 6 is designed to attach to the elastic members 4 at end arms 12 the same as the conventional normal leather pouch attaches to any slingshot. The angle arms 11 of the pouch 6 are different from a conventional normal leather pouch in that the angle arms 11 close the pouch 6 via elastic member 4 force and in that the angle arms 11 are curved or angled inwards towards the center in order to aid in securing the paintball 13 in position.

Figure 2:
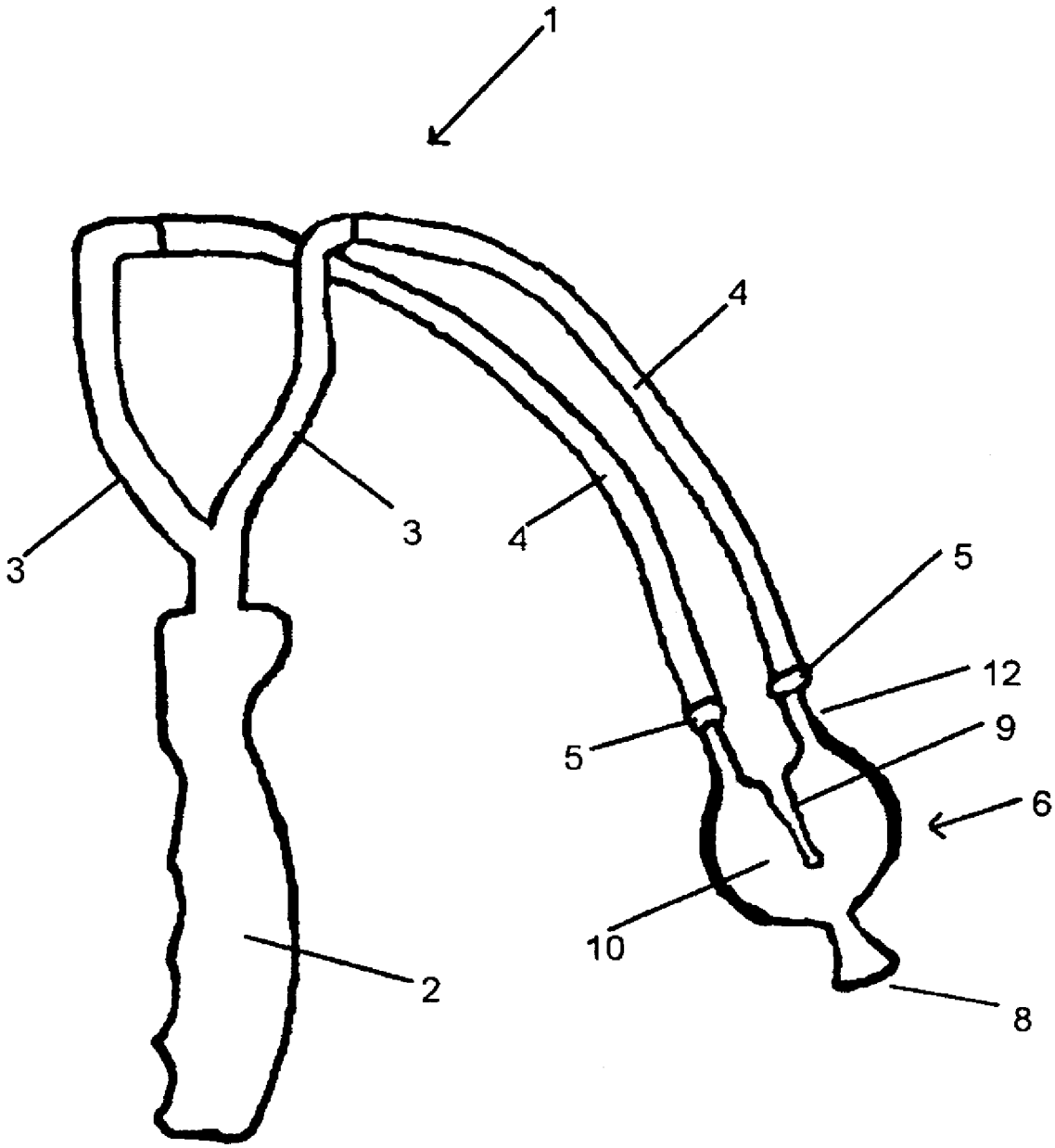
FIG. 2 is a side view of the entire slingshot assembly illustrating the paintball pouch, elastic members, and open slit in the relaxed condition.
Figure 3:
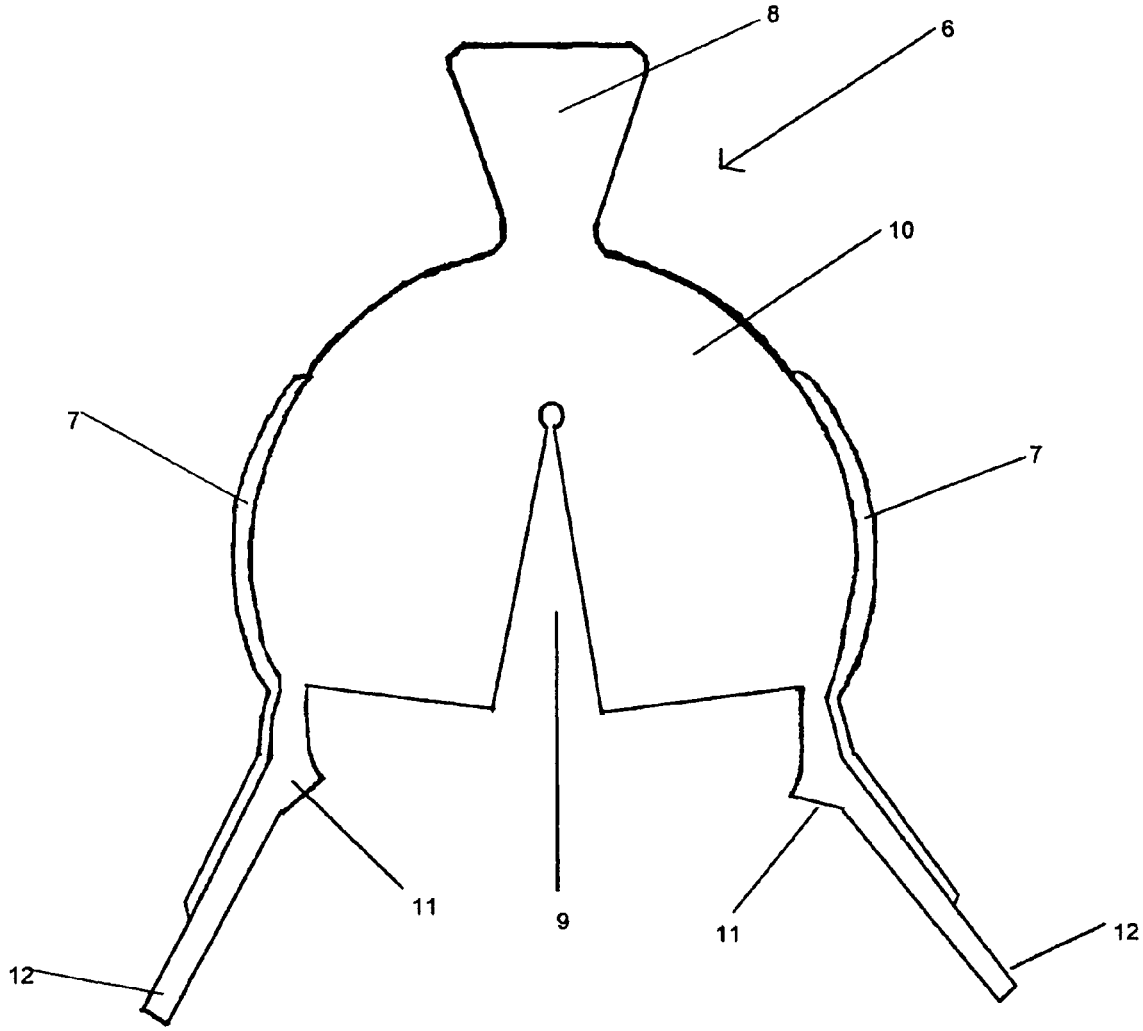
FIG. 3 is a top view of the paintball pouch in the relaxed position illustrating the open slit in the pouch wall and illustrating the triangular handle.
Figure 4:
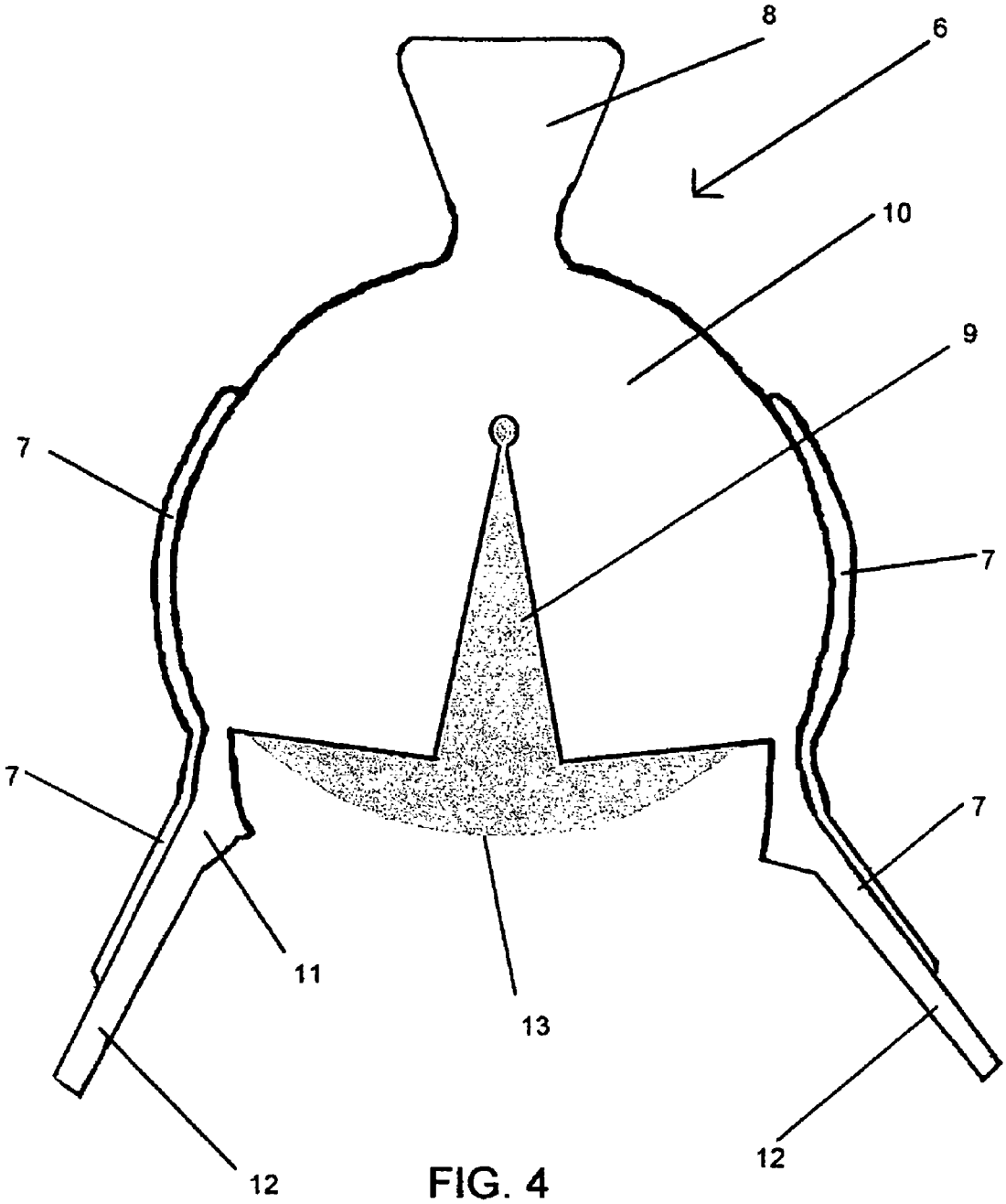
FIG. 4 is a top view of the paintball pouch, with paintball, in the relaxed position illustrating the narrower open slit in the pouch wall, paintball, and the triangular handle.
Figure 5:
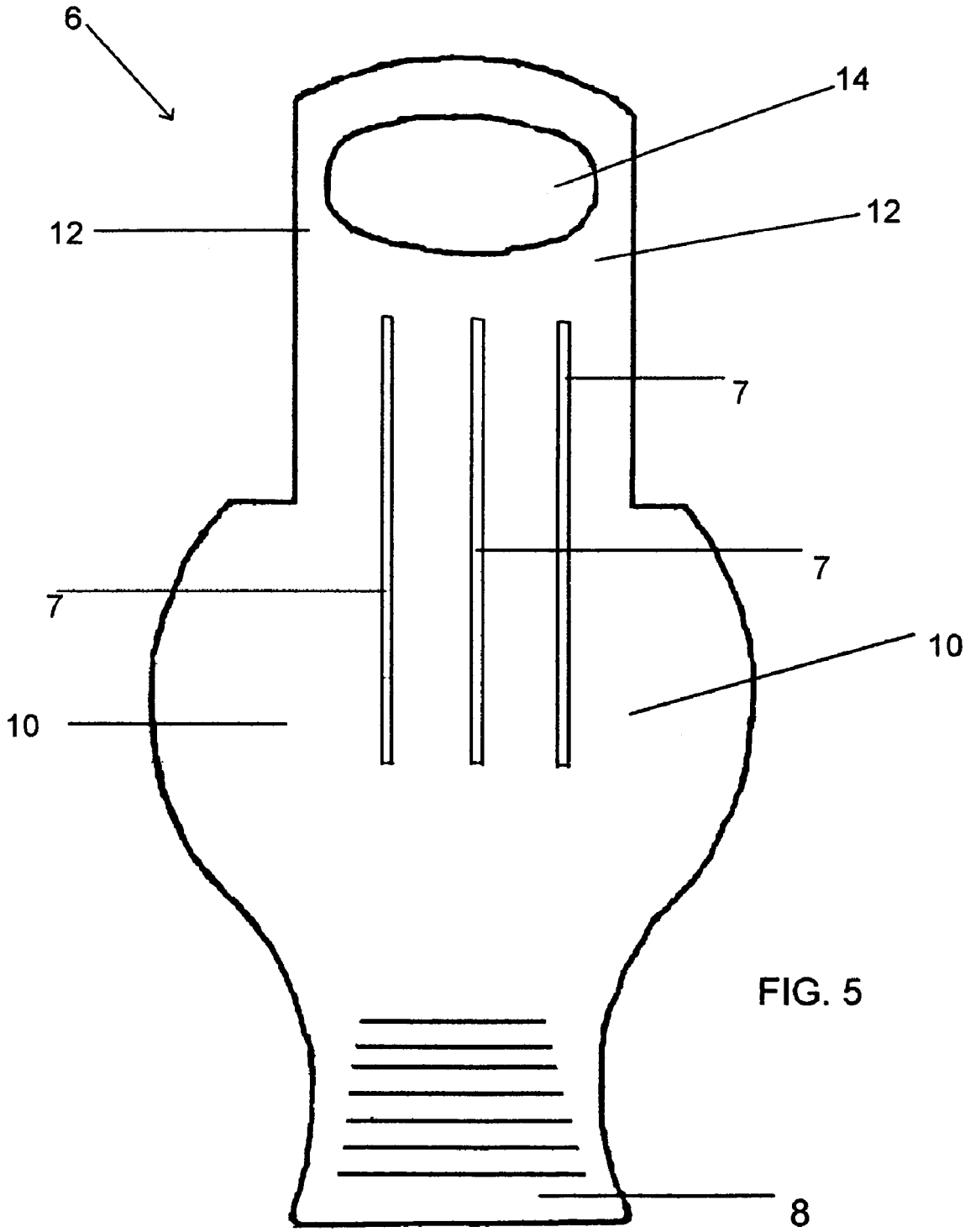
FIG. 5 is a side view of the paintball pouch in the relaxed position illustrating the openings for the connectors and elastic members, support ribs and the triangular handle.
Figure 6:
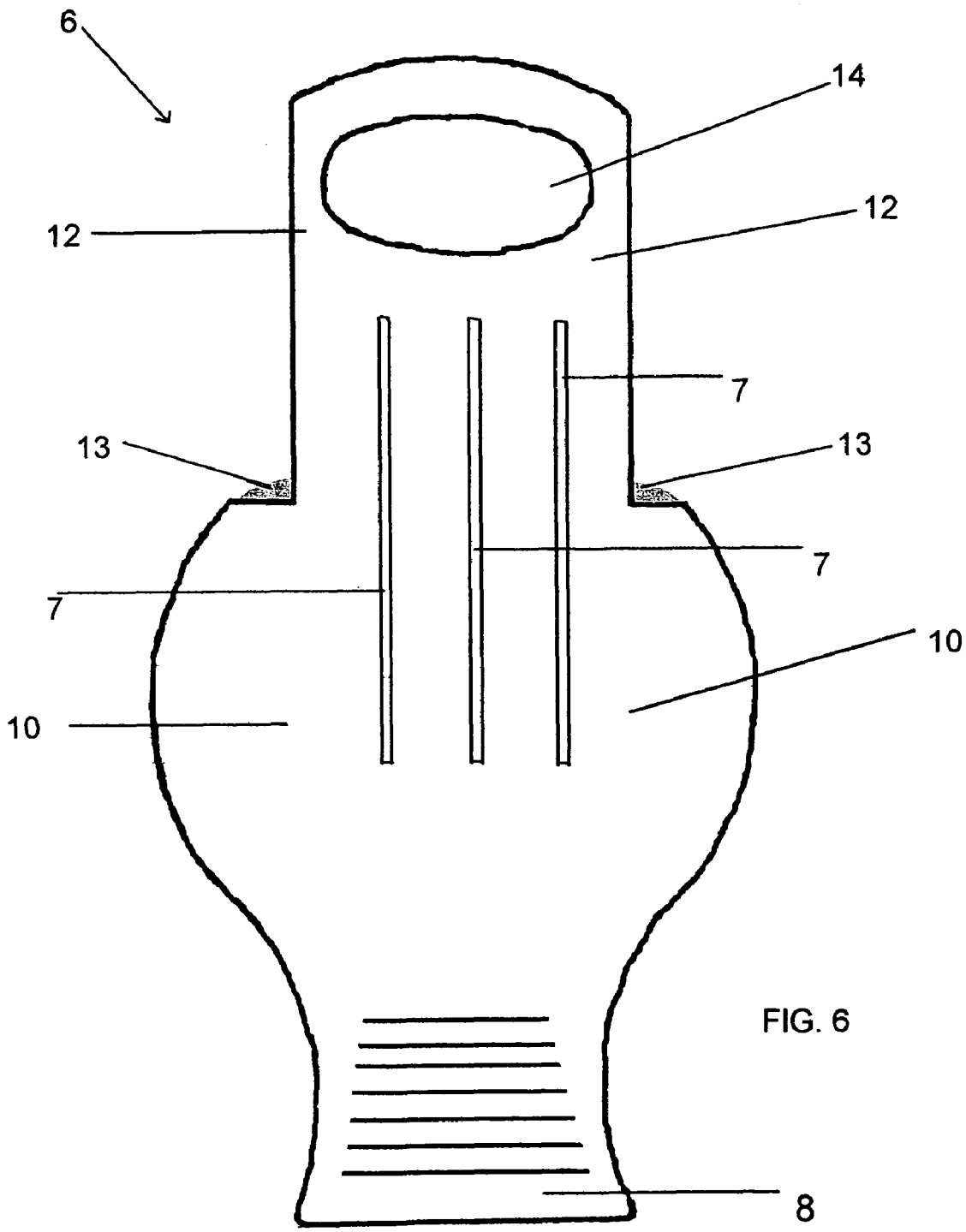
FIG. 6 is a side view of the paintball pouch, with paintball, in the relaxed position illustrating the amount of surface are covered by the pouch.
Figure 7:
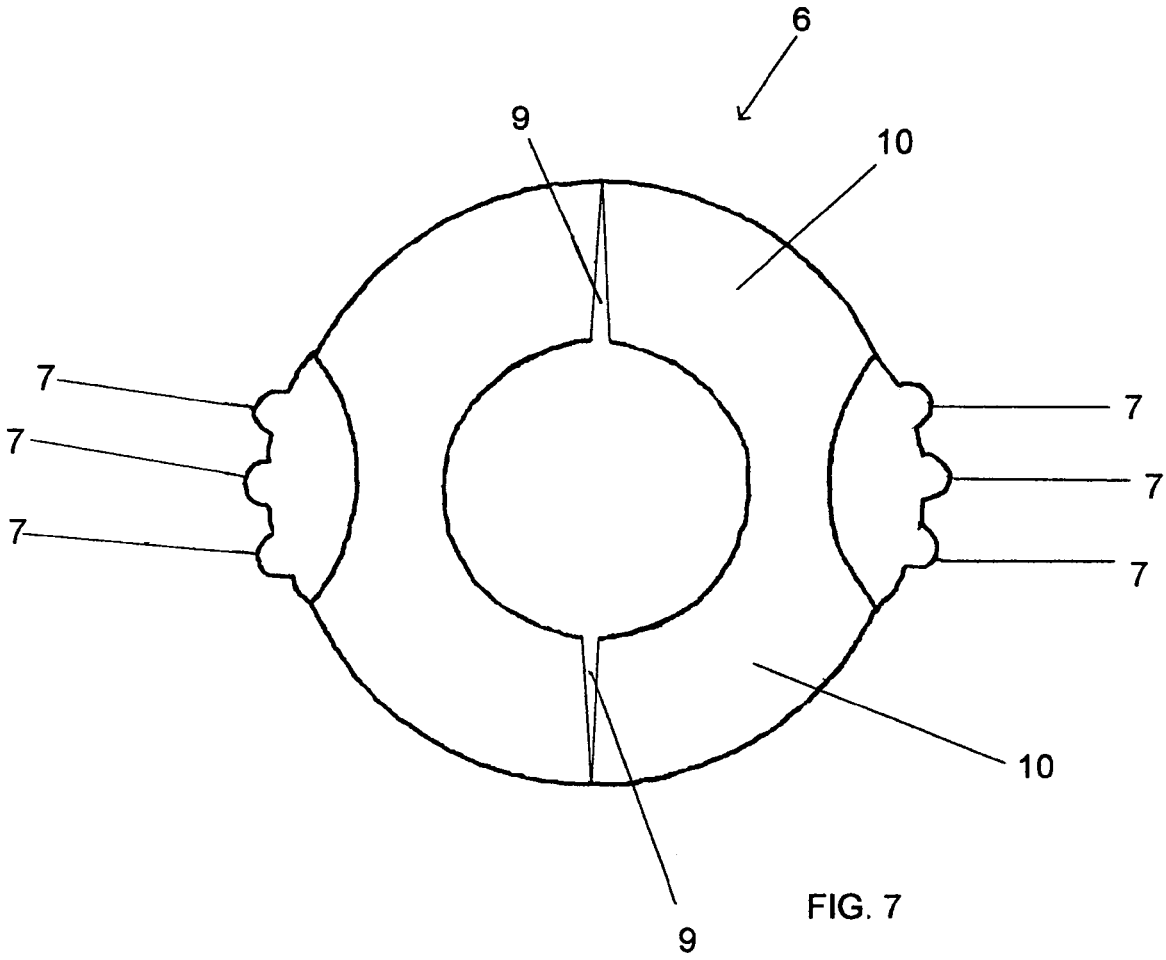
FIG. 7 is a frontal view of the paintball pouch in the relaxed position illustrating the ribs and slits.
Figure 8:
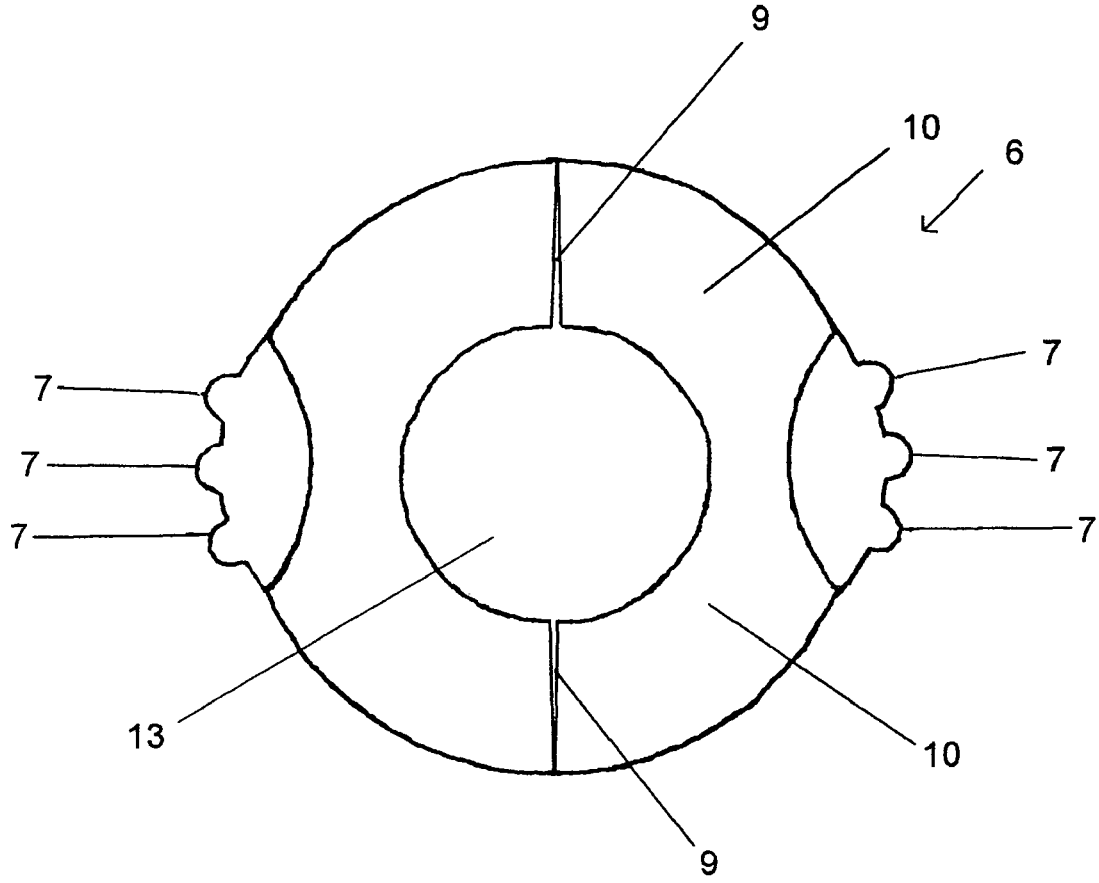
FIG. 8 is a frontal view of the paintball pouch, with paintball, in the loaded or ready position illustrating the paintball securely centered in place and the nearly closed slits in the pouch wall.

When the pouch 6 is pulled back to the ready position, the pouch 6 covers the entire circumference around the paintball 13 exposing only a small portion of the paintball. The pouch wall 10 or lining pulls together so approximately 20% to 25% of the paintball 13 is exposed while the remaining 75% to 80% of the paintball is covered. The walls 10 hold and apply equal pressure to the paintball 13. As a result of the uniform pressure on 75% to 80% of the paintball 13, it can be fired with confidence that it will not burst or be crushed during the process. Other slingshots with a pouch may hold a projectile in place without the necessity of continually gripping the projectile through the pouch 6; unfortunately, the entire force from the elastic members is concentrated on only approximately 25% or less of the paintball surface area resulting in frequent unintentional paintball burst. As best shown in FIGS. 2, 3 and 4 in the relaxed position, the split or slit 9 in the pouch allows the pouch 6 to open so the paintball 13 or projectile can be loaded easily into the pocket while in the relaxed position and remain securely in place, while the user pulls back the triangular handle 8 or release to the ready or loaded position. As shown in FIG. 8 in the ready position, the force from the elastic members 4 result in the narrowing or closing of the split or slit 9 in the pouch 6.

In further detail, still referring to the drawings, the pouch 6 is connected to the slingshot 1 by elastic members 4 that attach to the pouch 6 through openings 14 in the end arms. The pouch 6 must be sufficiently large so that a standard paintball 13 can be held in the pouch 6. Matching the proper caliber paintball 13 or projectile to the pouch 6 aids in securing the paintball 13 in the pouch 6. The pouch 6 can be molded in different calibers to fit different paintballs with 40 caliber, 50 caliber and 68 caliber being the most common. The triangular release 8 must be sufficiently large so as to be gripped and pulled back between the thumb and index finger.

The construction details of the invention as shown in the drawings are that the pouch 6 is molded or carved from a sufficiently strong, lightweight, flexible, and pliable material such as rubber or polyethylene. But of course the pouch 6 can be made from other sufficiently strong, lightweight, flexible, and pliable materials. The walls 10 vary in thickness. The walls 10 are about 0.3 inches thick near the triangular strap and about 0.11 inches thick near the end arms 12 would be sufficient. A pouch 6 diameter of about 1.0 inches would be sufficient since the diameter of a standard paintball 13 is about 0.68 in.

The advantages of the present invention include, without limitation, an improved slingshot pouch 6 designed to securely hold pressure sensitive projectiles such as paintballs 13. By applying equal pressure at all points on the paintball 13 surface the force is evenly distributed so as to prevent the paintball 13 from bursting or crushing due to uneven pressure on the paintball during the firing process created by the force of the stretched elastic members. The pouch 6 will hold the paintball in place without the need of gripping it through the pouch 6. Another advantage of the invention is that it improves slingshot 1 accuracy. With a uniform pressure distribution over the paintball 13, accuracy is improved because the paintball or projectile is held more securely in place. The paintball 13 cannot move up down or side to side while in the pouch 6, so the paintball 13 or projectile is fired from the same place each and every time it is released. If care is taken the slingshot 1 could remain loaded for an undetermined period of time thus allowing the user to remain at the ready position until a decision is made to fire. The pouch 6 will hold the paintball 13 in place without the need of gripping it through the pouch. A user can accurately fire a paintball 13 loaded with paint or deer scent in a gel form at a target without the worry of the paintball bursting before release. This eliminates the concern over getting paint or deer scent on the user's body or clothing. Target accuracy is improved since the paintball 13 is securely held in the pouch 1.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention as claimed.

I claim:

1. A slingshot pouch comprising:

a flexible pliable material of sufficient size, and approximately shaped as a sphere in all dimensions to accommodate a round pressure sensitive projectile of approximately the same diameter as said sphere and forming round curved walls of variable thickness with a smooth inside lining which contacts essentially the entire surface area of said projectile while exposing only a small portion of said projectile, a gripping element on the rearward side of said pouch;

a pair of angle arms curved inwards towards the center on the frontal side of said pouch;

a pair of end arms and a plurality of openings to connect elastic members of equal lengths;

a plurality of ribs on the outside of said round curved walls and extending parallel to and horizontally along said end arms;

a slit in said round curved walls on top of said pouch and between said angle arms; and a means of securing said projectile inside said pouch, whereby said elastic members exert force to close said angle arms and said round curved walls around said projectile to contact said projectile over essentially the entire surface area without gripping said projectile through said round curved walls.

2. The slingshot pouch of claim 1, wherein said material includes a means of forming a pouch from said material is to equally distribute the force exerted by the elastic members.

3. The slingshot pouch of claim 1, wherein said ribs extend down the end arms for projectile support.

4. The slingshot pouch of claim 1, wherein said gripping element includes a triangular handle or release to pull back and hold said material in the ready position.

5. The slingshot pouch of claim 1, wherein said openings are in end arms.

6. The slingshot pouch of claim 1, wherein said openings are two in number.

7. The slingshot pouch of claim 1, wherein said slit allows said material to form a pocket to encompass a projectile.

8. The slingshot pouch of claim 2, wherein said means of forming a pouch to equally distribute the force exerted by the elastic members is to prevent the crushing or bursting of pressure sensitive projectiles.

9. The slingshot pouch of claim 3, wherein said ribs provide additional pressure to form and to close the pouch.

10. The slingshot pouch of claim 1, wherein said material includes walls of variable thickness.

11. The slingshot pouch of claim 10, wherein said walls are thinner towards the openings and thicker towards the triangular handle or release.

12. The slingshot pouch of claim 1, wherein said angle arms provide projectile support.

13. The slingshot pouch of claim 12, wherein said angle arms provides pressure to form and close pouch.

14. The slingshot pouch of claim 1, wherein said material is rubber.

15. The slingshot pouch of claim 1, wherein said elastic members exert force to fold said material to cover said projectile over essentially 75% to 80% of the entire surface area.

16. The slingshot pouch of claim 1, wherein said pressure sensitive projectile is a paintball.

17. A slingshot pouch comprising:

a flexible pliable material of sufficient size, and approximately shaped as a sphere in all dimensions to accommodate a round pressure sensitive projectile of approximately the same diameter as said sphere and forming round curved walls of variable thickness with a smooth inside lining which contacts essentially the entire surface area of said projectile while exposing only a small portion of said projectile, a gripping element on the rearward side of said pouch;

a pair of angle arms curved inwards towards the center on the frontal side of said pouch;

a pair of end arms and a plurality of openings to connect elastic members of equal lengths;

wherein the thickness of the round curved walls is approximately three times greater near the gripping element than near the end arms;

a plurality of ribs on the outside of said round curved walls and extending horizontally and parallel to said end arms;

a slit in said round curved walls on top of said pouch and between said angle arms; and a means of forming a pouch from said material, whereby said elastic members exert force to fold said material to contact a projectile over essentially 75% to 80% of the entire surface area of said projectile.

* * * * *